US009322120B2

(12) United States Patent
Suzuki

(10) Patent No.: US 9,322,120 B2
(45) Date of Patent: Apr. 26, 2016

(54) ZIGZAG SEWING MACHINE AND AUTOMATIC-PAUSE CONTROL METHOD OF ZIGZAG SEWING MACHINE

(71) Applicant: Janome Sewing Machine Co., Ltd., Hachioji-shi, Tokyo (JP)

(72) Inventor: Ryosuke Suzuki, Hachioji (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 0 days.

(21) Appl. No.: 14/611,538

(22) Filed: Feb. 2, 2015

(65) Prior Publication Data

US 2015/0368837 A1 Dec. 24, 2015

(30) Foreign Application Priority Data

Jun. 18, 2014 (JP) ..... 2014-125295

(51) Int. Cl.
*D05C 5/02* (2006.01)
*D05B 19/08* (2006.01)
*D05B 19/12* (2006.01)

(52) U.S. Cl.
CPC ..... *D05B 19/08* (2013.01); *D05B 19/12* (2013.01)

(58) Field of Classification Search
CPC ..... D05B 19/02; D05B 19/04; D05B 19/06; D05B 19/08; D05B 19/10; D05B 19/12; D05C 5/00; D05C 5/02
USPC ..... 700/136–138
See application file for complete search history.

(56) References Cited

U.S. PATENT DOCUMENTS 5,794,552 A * 8/1998 Owaki ..... D05B 19/105 112/102.5
2008/0078312 A1* 4/2008 Hayakawa et al. ..... D05C 7/00 112/102.5
2008/0190339 A1* 8/2008 Hayakawa ..... D05B 19/02 112/470.04
2014/0116309 A1* 5/2014 Maki ..... D05B 19/12 112/470.03

FOREIGN PATENT DOCUMENTS

JP 2000-218074 A 8/2000

* cited by examiner

*Primary Examiner* — Nathan Durham
(74) *Attorney, Agent, or Firm* — Westerman, Hattori, Daniels & Adrian, LLP

(57) ABSTRACT

A zigzag sewing machine including a sewing mechanism; a first storage device that stores pattern data that include attribute data and stitch data; a pattern selection section that sequentially selects optional pattern data stored in the first storage device; a second storage device that stores pattern data that have been selected by the pattern selection section as an arranged combinational pattern; a command data insertion section that inserts and adds pause data at an optional position midway of a pattern data string stored in the second storage device; a pause command section that reads out the pause data and that supplies the pause signal to the sewing machine drive unit; and a display device that displays the combinational pattern, the display device further displaying a pause symbol at a position in the combinational pattern where the pause symbol has been inserted and added.

20 Claims, 12 Drawing Sheets

ZIGZAG SEWING MACHINE AND AUTOMATIC-PAUSE CONTROL METHOD OF ZIGZAG SEWING MACHINE

BACKGROUND OF THE INVENTION

1. Field of the Invention

The present disclosure relates to a zigzag sewing machine that sews a stitch pattern by a left-right swing of a vertically reciprocating needle bar mounted with a needle at a lower end thereof and by a forward-rearward feed of a feed dog and, more particularly, relates to a zigzag sewing machine that automatically pauses in the midst of sewing a combinational pattern and to an automatic-pause control method of a zigzag sewing machine.

2. Description of the Related Art

As an electronic zigzag sewing machine that sews a stitch pattern by controlling a left-right swing of a vertically reciprocating needle bar mounted with a needle at a lower end thereof and by controlling a forward-rearward feed of a feed dog, a sewing machine that can sew a combinational pattern by using a so-called "memory function" is known that stores, on a ROM or the like, pattern data of a variety of patterns, such as a "practical pattern", a "stitched ornament pattern", and a "character pattern", and that optionally selects (reads out) and stores in a RAM or the like in the selected order a plurality of pieces of pattern data from the stored pattern data to enable each of the stitch patterns to be sewed in the above order (Japanese Unexamined Patent Application Publication No. 2000-218074, for example).

Methods of sewing a pattern with a zigzag sewing machine includes "continuous stitching" in which a single pattern is repeatedly sewed until a user stops the sewing machine and "combination stitching" in which a plurality of types of patterns are sewed as a pattern string arranged in a selected order. The user operates the sewing machine in the following manner.

First, in performing continuous stitching, the sewing machine is stopped by operation of a key switch or a foot controller when the user has performed sewing to a certain length.

Next, in performing combination stitching, the sewing machine is set so as to stop when sewing of the pattern string is completed, or the sewing machine is stopped by operation of the key switch or the foot controller when the user has completed sewing an optional pattern.

However, in the zigzag sewing machine described in Japanese Unexamined Patent Application Publication No. 2000-218074, when sewing a combinational pattern, the sewing machine is set so as to automatically stop at the point where sewing of the pattern string is completed, and in combination stitching, a key switch or a foot controller needs to be operated when the sewing machine is to be stopped at a point where sewing of either one of the patterns has been completed and, thus, there is no way to automatically stop the sewing machine.

Accordingly, when changing the color of the thread (color change) midway of the pattern string or when changing the sewing position midway of the pattern string, the user needs to stop the sewing machine manually (operating the key switch or the foot controller). Accordingly, the user needs to pay close attention to the timing to stop the sewing machine while dropping the sewing speed, for example, in order to avoid the sewing machine from stopping before the targeted position or, on the other hand, to avoid excessive sewing.

Other than the above, the user may utilize the function of the sewing machine that automatically stops when a pattern string has been sewed and may divide the pattern string into two pattern strings; however, the user needs to take the trouble of selecting, again, the second pattern string after sewing the first pattern string.

Furthermore, when the pattern data strings are saved as data files, each of the pattern data strings needs to be saved in separate files and the user needs to remember which data files are to be combined.

SUMMARY OF THE INVENTION

The present disclosure is directed to overcome the above problems and an object thereof is to provide a zigzag sewing machine that is, by allowing insertion and addition of pause data midway of a pattern data string constituting a selected combinational pattern, capable of, when sewing the combinational pattern, pausing automatically at a set position midway of the combinational pattern while sewing of the combinational pattern is carried out and restarting sewing of the combinational pattern from the paused position when sewing is restarted, and to provide an automatic-pause control method of a zigzag sewing machine.

In order to overcome the above problem, the present disclosure is a zigzag sewing machine that sews a combinational pattern and that includes a sewing mechanism that is driven by a sewing machine drive unit, the sewing mechanism forming a stitch pattern by a left-right swing of a vertically reciprocating needle bar mounted with a needle at a lower end thereof and by a forward-rearward feed of a feed dog; a first storage device that stores a plurality of pieces of pattern data including attribute data related to a pattern type and stitch data that controls the left-right swing of the needle bar and the forward-rearward feed of the feed dog; a pattern selection section that sequentially selects optional pattern data from the plurality of pieces of pattern data stored in the first storage device; a second storage device that stores a plurality of pieces of pattern data that have been selected by the pattern selection section as an arranged combinational pattern; a command data insertion section that inserts and adds pause data at an optional position midway of the pattern data string constituting the combinational pattern stored in the second storage device; a pause command section that reads out the pause data that has been inserted and added with the command data insertion section and that supplies the pause signal to the sewing machine drive unit; and a display device that displays the combinational pattern corresponding to the pattern data selected with the pattern selection section, the display device further displaying a pause symbol, the pause symbol corresponding to the pause data that has been inserted and added with the command data insertion section, at a position in the combinational pattern where the pause symbol has been inserted and added.

Furthermore, an automatic-pause control method of a zigzag sewing machine of the present disclosure is an automatic-pause control method of a zigzag sewing machine, the zigzag sewing machine being driven by a sewing machine drive unit and forming a stitch pattern by a left-right swing of a vertically reciprocating needle bar mounted with a needle at a lower end thereof and by a forward-rearward feed of a feed dog, the method including the steps of sequentially selecting optional pattern data from a first storage device that stores a plurality of pieces of pattern data including attribute data related to a pattern type and stitch data that controls the left-right swing of the needle bar and the forward-rearward feed of the feed dog; storing, in a second storage device, the plurality of pieces of pattern data that have been selected in the step of sequentially selecting pattern data as an arranged combinational pattern; displaying, on a display device, the combinational pattern corresponding to the pattern data selected in the step of sequentially selecting pattern data; inserting and adding pause data at an optional position midway of a pattern data string constituting the combinational pattern stored in the step of storing in the second storage device; displaying a pause symbol that corresponds to the pause data inserted in the step of inserting and adding pause data, the pause symbol being displayed in the combinational pattern on the display device at a position where the pause symbol has been inserted; and supplying a pause signal to the sewing machine drive unit after reading out the pause data that have been inserted in the step of inserting and adding pause data.

By inserting and adding pause data at an optional position midway of the pattern data string constituting the combinational pattern, the zigzag sewing machine and the automatic-pause control method of a zigzag sewing machine of the present disclosure automatically stops the sewing machine at a position where the pause data has been inserted and added when a pattern string is sewed with combination stitching; accordingly, not like when the user manually stops the sewing machine, the user does not have to look for the timing to stop the sewing machine and, thus, labor of the user can be reduced.

Furthermore, the zigzag sewing machine and the automatic-pause control method of a zigzag sewing machine of the present disclosure separates a pattern string into two while not requiring the user to perform selection of the second pattern string once more after sewing of the first pattern string is completed even in a sewing machine that has a function of automatically stopping the sewing machine after sewing of the first pattern string is completed; accordingly, labor of the user can be reduced.

Furthermore, in the zigzag sewing machine and the automatic-pause control method of a zigzag sewing machine of the present disclosure, even if there is no information on the pause position in the pattern data of the pattern string that has been input in the zigzag sewing machine, the sewing machine can be stopped by setting a pause position on the terminal side, such as a personal computer or a tablet, that is capable of communicating with the sewing machine, by regularly performing communication between the terminal and the sewing machine, and by transmitting a pause command to the sewing machine from the terminal when the pause position is reached while the sewing machine is sewing the pattern string.

BRIEF DESCRIPTION OF THE DRAWINGS

FIGS. 11A and 11B illustrate an example of a pattern string formed of stitched ornament patterns, in which FIG. 11A is a diagram illustrating a display state of a pattern string display window of the screen display device and FIG. 11B is a diagram illustrating a sewing state of the pattern string.

DESCRIPTION OF THE PREFERRED EMBODIMENTS

A zigzag sewing machine of the present disclosure will be described next with reference to the drawings illustrated in exemplary embodiments.

First Exemplary Embodiment

Figure 1:
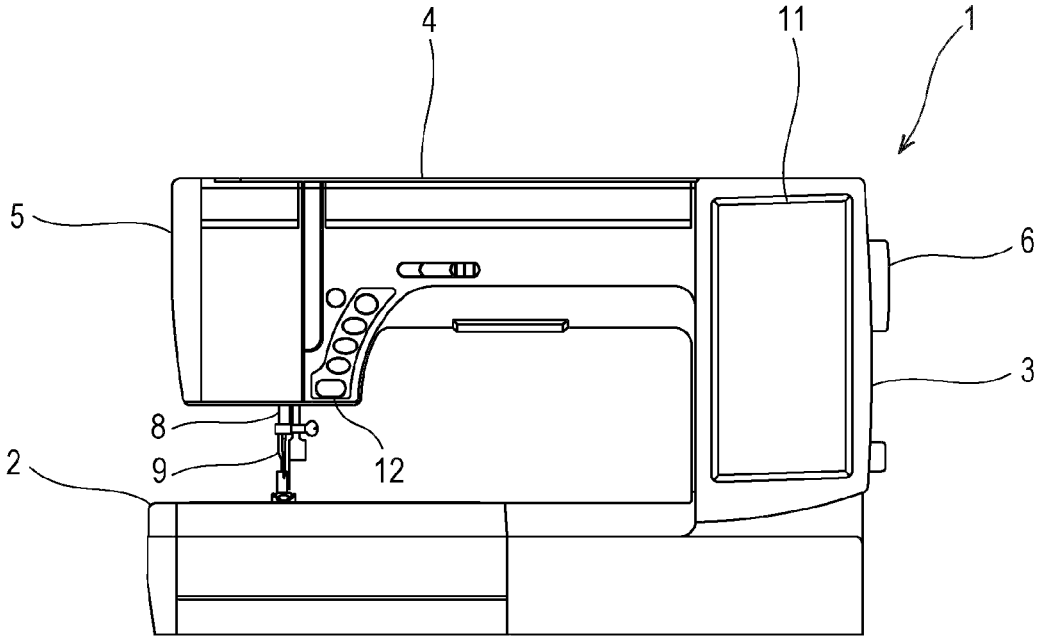
FIG. 1 is a front view illustrating an appearance of a zigzag sewing machine according to the present disclosure.

In the following description, the lateral direction in the front view illustrated in FIG. 1 is referred to as "left-right", the longitudinal direction therein is referred to as "up-down", and the direction perpendicular to the sheet surface is referred to as "front-rear".

Referring to FIG. 1, a sewing machine frame 1 includes a head portion 2 at a lower portion thereof, a pillar portion 3 that extends upwards from the right side of the head portion 2, an arm portion 4 that extends leftwards from the pillar portion 3, and a head portion 5 that is formed at the left end portion of the arm portion 4.

Figure 2:
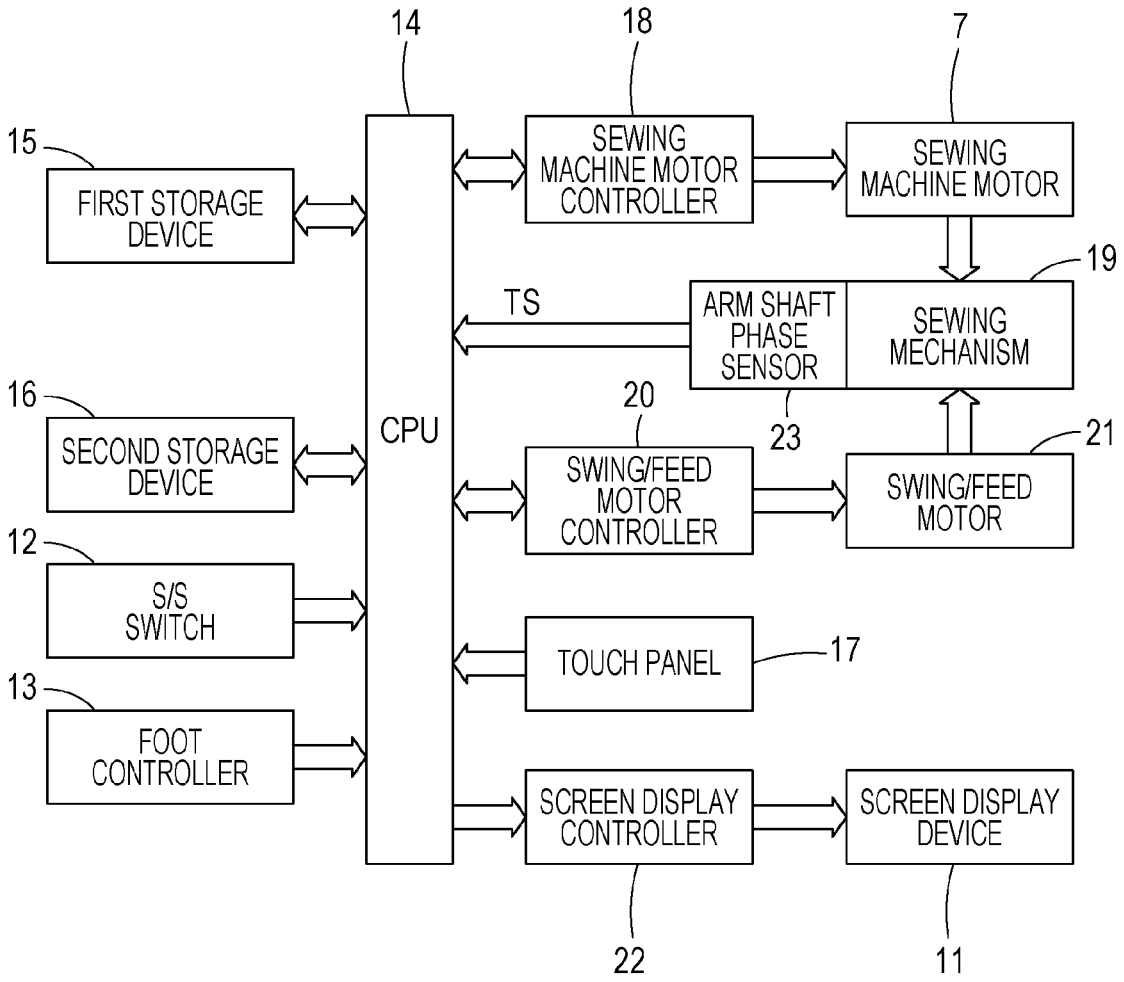
FIG. 2 is a block diagram illustrating a control system of a zigzag sewing machine of a first exemplary embodiment.

The arm portion 4 rotatably supports an arm shaft (not shown) that traverses inside the arm portion 4 in a horizontal direction. A pulley 6 attached to a right end of the arm shaft is coupled to a sewing machine motor 7 described later, which is arranged on the right side of the head portion 2, with a power transmission mechanism (not shown), and the arm shaft is configured to be rotated by the drive of the sewing machine motor 7 (FIG. 2).

A needle bar 8 that is driven by rotation of the arm shaft is supported in the head portion 5 so as to be capable of reciprocating in a vertical manner, and a needle 9 is mounted at a lower end of the needle bar 8. A needle-bar left-right swinging mechanism (not shown) that swings the needle bar 8 in the left-right direction is provided in the head portion 5.

A feed-dog lifting-lowering mechanism (not shown) that moves a feed dog (not shown) up and down, a feed-dog forward-rearward feeding mechanism (not shown) that moves the feed dog forward and rearward, and the like are provided in the head portion 2.

The feed-dog lifting-lowering mechanism is driven by the sewing machine motor 7, the needle-bar left-right swinging mechanism is driven by a swing motor described later for swinging the needle bar to the left and right, and the feed-dog forward-rearward feeding mechanism is driven by a feed motor described later for feeding the feed dog forward and rearward.

Furthermore, a screen display device 11, a front side of which is stacked with a transparent touch panel 17 (FIG. 2) described later, serving as a display device that displays selected stitch patterns thereon is disposed in the pillar portion 3, and a start/stop switch (an S/S switch) 12 that commands start and stop of the sewing machine is provided in the head portion 5.

As illustrated in a block diagram in FIG. 2, in the zigzag sewing machine of the present exemplary embodiment, a central processing unit (CPU) 14 is coupled to a first storage device 15 composed of a ROM with an I/O bus and is coupled to a second storage device 16 composed of a RAM with an I/O bus.

The first storage device 15 includes a plurality of storage areas. The storage areas include, for example, a control program storage area that stores a control program that controls the entire sewing machine, a data controlling program storage area that stores a data controlling program that controls pattern data in a manner described later, and a pattern data storage area that stores, for example, pattern data of a plurality of stitch patterns, which are pattern data each formed of attribute data and stitch data, and display data of the stitch pattern.

In the present exemplary embodiment, the pattern data of the stitch patterns are each configured in the following manner.

Figure 3:
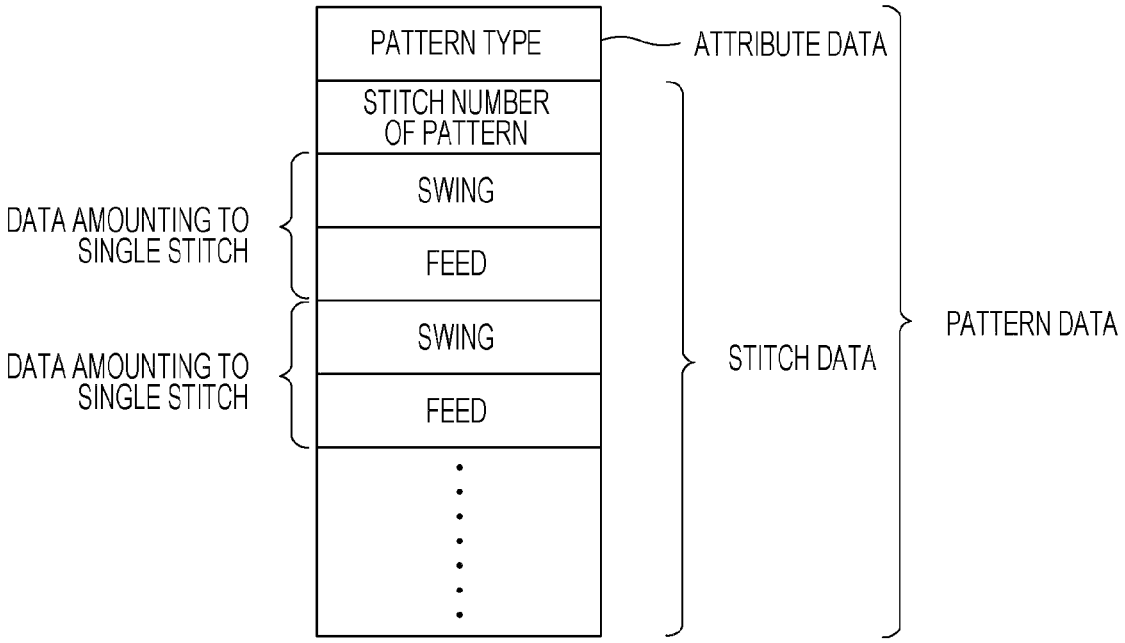
FIG. 3 is a schematic diagram illustrating a configuration of a pattern data in a storage area.

As illustrated in FIG. 3, the pattern data each stores data (attribute data) related to "the pattern type" at a head thereof, and "the stitch number of the pattern" at a second portion thereof. At a third portion and after, stitch data composed of "swing" data and "feed" data, the number of the stitch data being equivalent to the number of the stitches according to "the stitch number of the pattern", are stored.

The data (attribute data) related to "the pattern type" is "0" when the data is a terminal of a pattern data string, is "1" when the data is normal pattern data, is "2" when the data is pause data, is "3" when the data is finish-up stitching data, is "4" when the data is thread cutting data, and is "5" when the data is color change data.

Note that the "normal pattern" refers to a "practical pattern", a "stitched ornament pattern", a "character pattern", and the like that are stitched as a stitch pattern and is distinguished from command data such as the pause data, the finish-up stitching data, the thread cutting data, and the color change data that are only displayed on a display device as symbols and that are not actually stitched as stitching patterns.

Furthermore, the "stitch data" is composed of data associated with "the stitch number of the pattern", and the "swing" data and the "feed" data that are needed to stitch the stitch pattern.

The second storage device 16 includes, for example, a working storage area for temporarily storing various data and the like needed when executing the control program, and the pattern data storage area that stores pattern data of the pattern selected with the touch panel 17 serving as a pattern selection key described later that is a pattern selection section.

The S/S switch 12 is coupled to the CPU 14 with the I/O bus and, as described above, operation of the S/S switch 12 starts the sewing machine that is at a stop and stops the sewing machine that is in operation.

Similarly, a foot controller 13 is coupled to the CPU 14. Stepping onto the foot controller 13 starts the sewing machine that is at a stop, and the stitching speed of the sewing machine can be controlled by the extent to which the foot controller 13 is stepped on and, further, by stop stepping on the foot controller 13, the sewing machine in operation is stopped.

A variety of controllers are coupled to the CPU 14 with I/O busses. The arm shaft constituting a sewing mechanism 19 and the sewing machine motor 7 that drives the feed-dog lifting-lowering mechanism are connected to a sewing machine motor controller 18. The sewing machine motor controller 18 and the sewing machine motor 7 constitute a sewing machine drive unit.

An arm shaft phase sensor 23 that detects a rotational phase of the arm shaft is provided in the sewing mechanism 19, and a timing signal TS from the arm shaft phase sensor 23 is sent to the CPU 14.

A swing/feed motor controller 20 is constituted by two controllers that individually control a corresponding one of two stepping motors. A swing/feed motor 21 constituted by a needle-bar left-right swing stepping motor and a feed-dog forward-rearward feed stepping motor is connected to the swing/feed motor controller 20. The needle-bar left-right swing stepping motor and the feed-dog forward-rearward feed stepping motor individually control the needle-bar left-right swinging mechanism and the feed-dog forward-rearward feeding mechanism, respectively, constituting the sewing mechanism 19.

Furthermore, the screen display device 11 is coupled to a screen display controller 22 and, in the present exemplary embodiment, the screen display device 11 is constituted by a liquid crystal display portion and the transparent touch panel 17 stacked on the front side of the liquid crystal display portion.

The CPU 14 receives an operation signal from the touch panel 17 and controls the screen display controller 22, and by switching screen modes, various displays related to pattern stitching are displayed on the liquid crystal display portion and, further, various screen keys that are constituted together with the transparent touch panel 17 are displayed.

By operating the pattern selection key described later serving as the pattern selection section, pattern data of a desired stitch pattern is selected (read out) from the pattern data storage area of the first storage device 15, and the pattern data of the selected stitch pattern is stored in a predetermined storage area of the second storage device 16.

As described above, in the zigzag sewing machine of the present exemplary embodiment, pattern data related to a plurality of stitch patterns are stored in the first storage device 15, and a plurality of pieces of pattern data that have been sequentially selected from the first storage device 15 with the pattern selection section are stored in the second storage device 16 as a combinational pattern in which the plurality of pieces of pattern data are arranged in the selected order.

Referring next to FIGS. 4 to 10, a mode of use and an operational advantage of the present exemplary embodiment will be described with an exemplary case in which the combinational pattern is a pattern string "AddressTokyo Hachioji".

Figure 4:
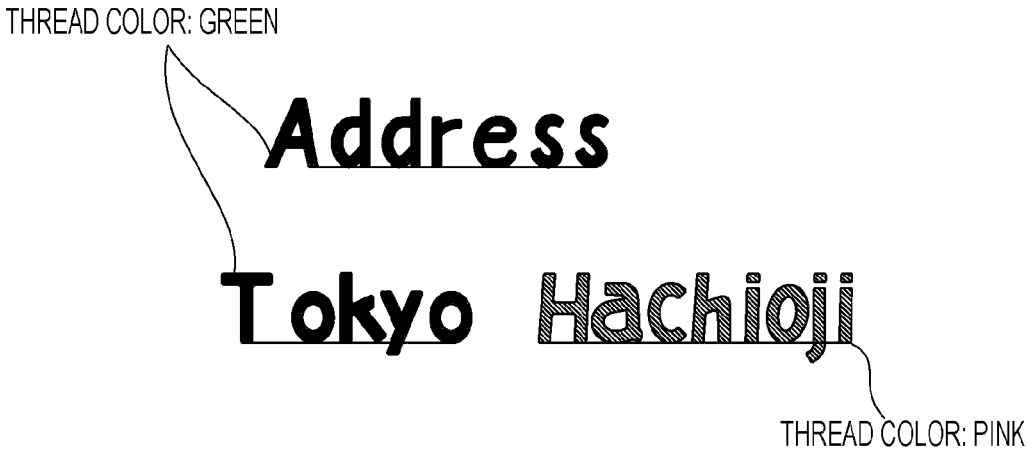
FIG. 4 is a diagram illustrating a sewing state of a pattern string formed of alphabetical characters.

In the above example, as illustrated in FIG. 4, the pattern strings formed of character patterns "Address Tokyo Hachioji" is divided into and stitched in two lines, namely, "Address" and "Tokyo Hachioji" and, further, the thread color is changed from green at the start of sewing to pink at a midway portion of the second line (from "Hachioji").

Conventionally, in order to sew the pattern string illustrated in FIG. 4, a function of the sewing machine that automatically pauses sewing when sewing of a pattern string is completed is used. First, after selecting "Address" as a pattern string, the pattern string is sewed, and after completion of the sewing, the sewing machine automatically pauses. In a similar manner, after selecting "Tokyo" as a pattern string, the pattern string is sewed while changing the sewing position. Finally, after changing the sewing thread from green to pink and after selecting "Hachioji" as a pattern string, the pattern string is sewed. As above, the pattern strings needs to be replaced (re-selected) at each break of the sewing operation.

In order to sew the pattern string illustrated in FIG. 4 with the present exemplary embodiment, a pause symbol may be added, at a portion after the normal pattern where pausing is intended, with the pattern selection section in the same manner as when the normal pattern is selected. Regarding the addition of the pause symbol, the pause symbol can be input while the patterns are input in order from the top, or the pause symbol may be added by, after the pattern string has been input, inserting the pause symbol at any position in the pattern string.

Herein, a case in which the pause symbol is added by inserting the pause symbol after input of the pattern string will be described.

Figure 5:
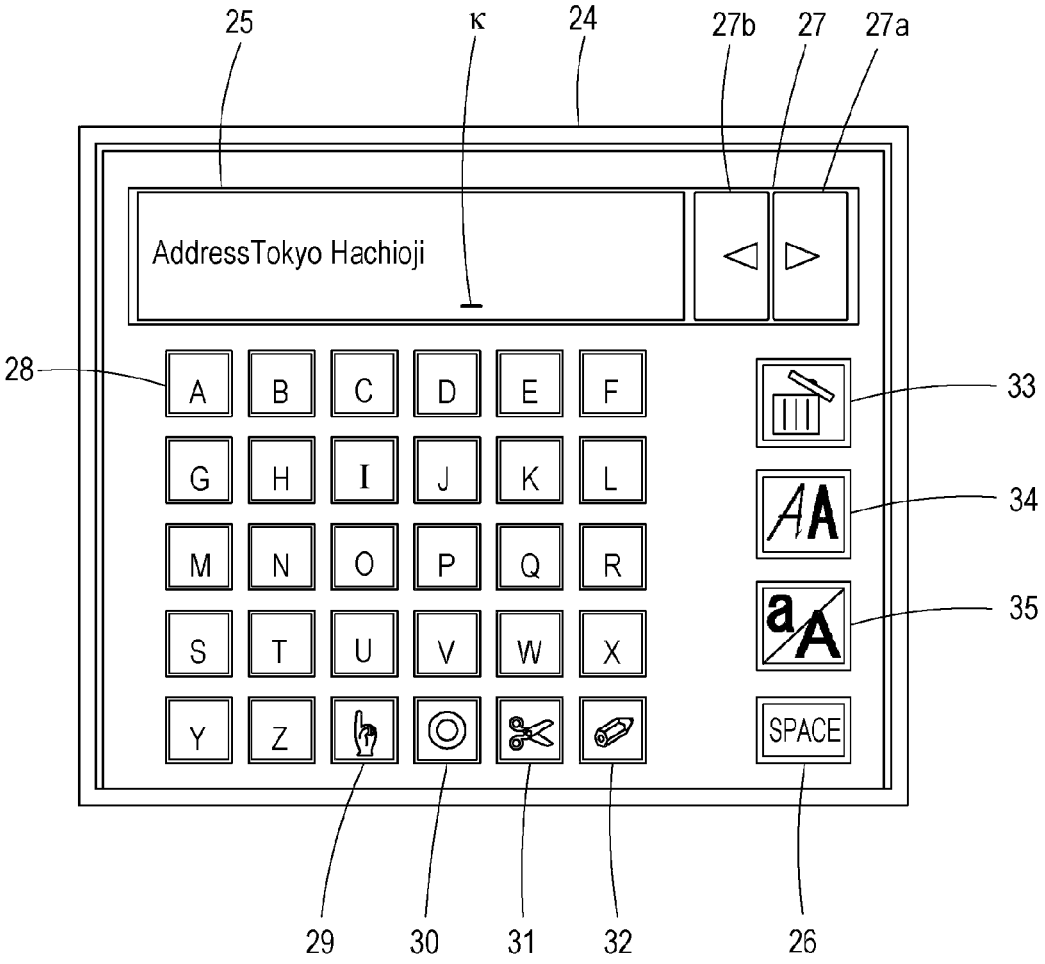
FIG. 5 is a diagram illustrating a display state of a screen display device before insertion of pause symbols.

When a mode selection key (not shown) of the screen display device 11, the front side of which is stacked with the transparent touch panel 17, is touched, as illustrated in FIG. 5, a combinational pattern input mode screen (hereinafter, referred to as a "pattern string mode screen") 24 is displayed.

At an upper portion of the pattern string mode screen 24, a pattern string display window 25 that is long sideways and that displays the input pattern string, and cursor shift keys 27 including a rightward shift key 27*a* and a leftward shift key 27*b* that move a cursor κ, which is displayed in the display window 25, to the left and right are arranged side-by-side.

Furthermore, in the pattern string mode screen 24, below the display window 25, normal pattern selection keys 28 formed of alphabetical character patterns from A to Z, a pause symbol key 29, a finish-up stitching symbol key 30, a thread cutting symbol key 31, and a color change symbol key 32 are arranged.

Furthermore, a pattern delete key 33, a font selection key 34, an uppercase/lowercase switching key 35, and a space key 26 are arranged below the cursor shift keys 27.

In order to input the combinational pattern illustrated in FIG. 4 with the pattern string mode screen 24, the normal pattern selection keys 28, the uppercase/lowercase switching key 35, and the space key 26 are operated to select an uppercased alphabet, a lowercased alphabet, or to select a space; accordingly, the pattern data of the selected alphabet in uppercase or in lowercase or the space is read out to the CPU 14 from the first storage device 15 illustrated in FIG. 2, and the pattern data is written to the second storage device 16.

At the same time, the CPU 14 reads out stitch pattern display data that displays a character or a space that corresponds to the alphabet in uppercase or lowercase or the space that has been selected from the first storage device 15, and outputs the stitch pattern display data to the screen display controller 22; accordingly, as illustrated in FIG. 5, "Address-Tokyo Hachioji" is displayed in the pattern string display window 25 of the screen display device 11 while being input as a single pattern string.

From the above state, if the S/S switch 12 or the foot controller 13 is operated to start the sewing machine to start sewing, the patterns are sewed to the end as a pattern string formed of a single line.

Accordingly, in the present exemplary embodiment, by operating the pause symbol key 29, the finish-up stitching symbol key 30, the thread cutting symbol key 31, and the color change symbol key 32, change in the stitching position and change in color can be performed midway of the pattern string "AddressTokyo Hachioji".

Specifically, in order to separate "Address" and "Tokyo Hachioji" into two lines, at the point when sewing of "Address" is completed, the sewing is paused and finished-up stitching and thread cutting are performed. Furthermore, color change is added between "Tokyo" and "Hachioji" in order to change the threat spool from green to pink.

As the key operation for the above, as illustrated in FIG. 5, the leftward shift key 27*b* of the cursor shift keys 27 is operated so that the cursor κ displayed in the pattern string display window 25 is shifted to a portion directly under "T". Subsequently, the pause symbol key 29, the finish-up stitching symbol key 30, and the thread cutting symbol key 31 are operated in this order so that a "single finger" α that is a pause symbol, a "double circle" β that is a finished-up stitching symbol, and "scissors" γ that is a thread cutting symbol are inserted and added between "s" and "T".

At the same time with the above, pattern data (command data) of each of the pause data, the finish-up stitching data, and the thread cutting data that have been selected from the first storage device 15 illustrated in FIG. 2 through key operation are read out to the CPU 14, and a portion between "s" and "T" of the pattern data of the pattern data string stored in the second storage device 16 is interrupted with the pattern data (command data) such that the pattern data (command data) are sequentially written therein.

Figure 6:
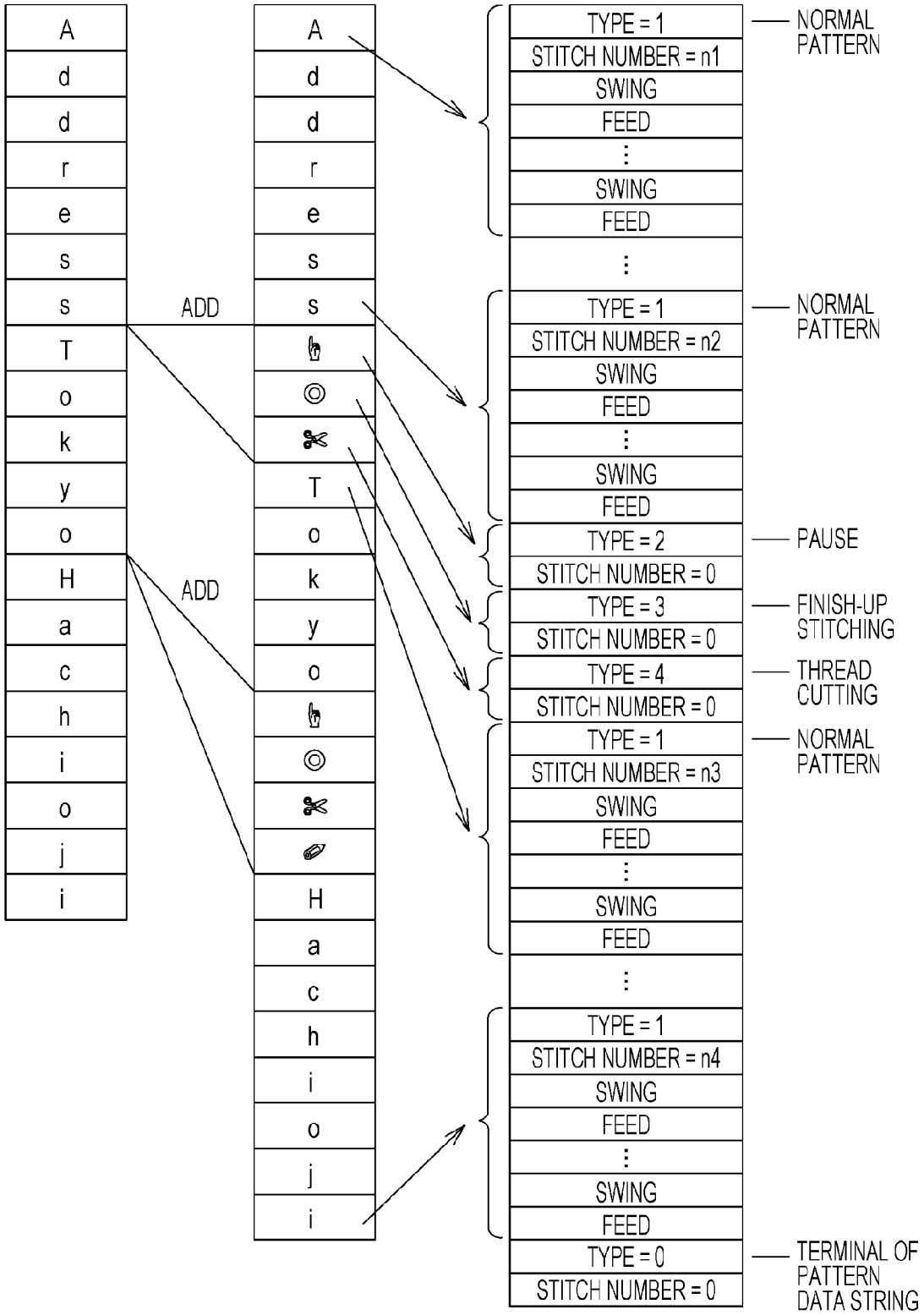
FIG. 6 is a schematic diagram illustrating a configuration of pattern data constituting a pattern string in a storage area.

The above writing operation of the pattern data will be described with the schematic diagram in FIG. 6. The pattern data selected through the key operation of the touch panel 17 is read out from the first storage device 15 and is written in the second storage device 16. With the above writing operation, as illustrated in the left column in FIG. 6, pattern data before the pause data and the like are inserted into the pattern data string is arranged in the second storage device 16, and in the middle column, pattern data after inserting and adding the pause data, the finish-up stitching data, and the thread cutting data is arranged in the second storage device 16.

Furthermore, the right column illustrates a specific arrangement of the pattern data in the pattern data storage area that corresponds to the arrangement of the pattern data in the middle column.

In the case of the present exemplary embodiment, in the normal pattern, "type=1", which is attribute data, together with "stitch number=n1" of the stitch data has a 2-byte configuration and the following data amounting to a single stitch has a 2-byte configuration formed of "swing" data and "feed" data.

Meanwhile, the "types", which are attribute data, of the "terminal of the pattern data string", the "pause", the "finish-up stitching", the "thread cutting", and the "color change" are "0", "2", "3", "4", and "5", respectively, and the "type" of each of the "stitch number" is "0" serving as dummy data.

Subsequently, the rightward shift key 27*b* is operated so that the cursor κ is shifted to a portion directly under "H", and the pause symbol key 29, the finish-up stitching symbol key 30, the thread cutting symbol key 31, and the color change symbol key 32 are operated so that the "single finger" α that is a pause symbol, the "double circle" β that is a finished-up stitching symbol, "scissors" γ that is a thread cutting symbol, and a "pencil" δ that is a color change symbol are inserted and added between "o" and "H"; accordingly, as described above, the corresponding pattern data are read out from the first storage device 15 and, at the same time, is written in the second storage device 16.

Figure 7:
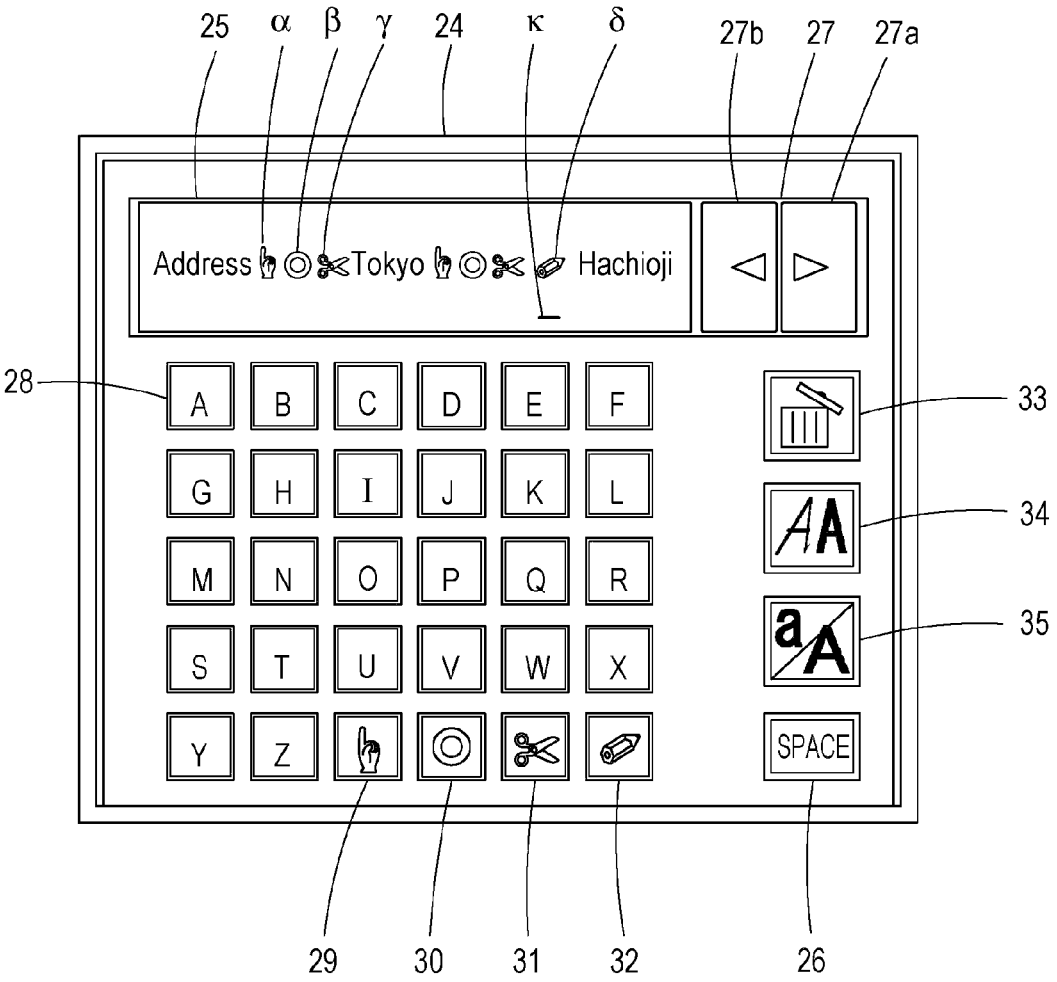
FIG. 7 is a diagram illustrating a display state of the screen display device after insertion of pause symbols.

With the above key operation, the stitch pattern that is illustrated in FIG. 7 is ultimately displayed in the pattern string display window 25 of the pattern string mode screen 24.

Note that finish-up stitching is performed before thread cutting in order to prevent loose threads from occurring, and during color change, since the thread spool is changed, thread cutting needs to be performed; accordingly, as illustrated in FIG. 7, symbols such as the pause symbol "single finger" α, the finish-up stitching symbol "double circle" β, and the thread cutting symbol "scissors" γ, and symbols such as the pause symbol "single finger" α, the finish-up stitching symbol "double circle" β, the thread cutting symbol "scissors" γ, and the color change symbol "pencil" δ are sequentially inserted and added.

Figure 8:
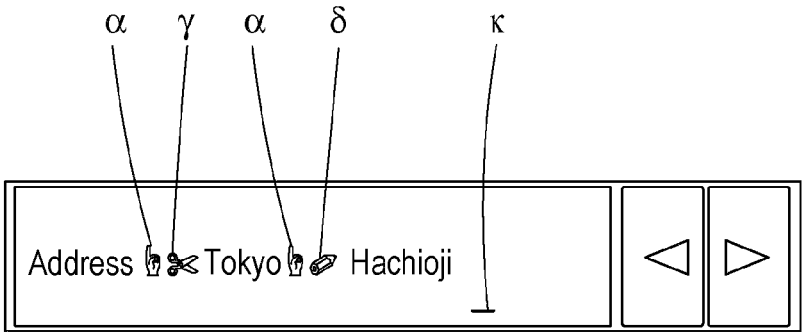
FIG. 8 is a diagram illustrating a display state of the screen display device in which a portion of the input is omitted.

Since the symbols need to be input nearly as a set, as illustrated in FIG. 8, by allowing the finish-up stitching symbol and the thread cutting symbol to be collectively abbreviated to and input as the thread cutting symbol "scissors" γ, and similarly, by allowing the finish-up stitching symbol, the thread cutting symbol, and the color change symbol to be collectively abbreviated to and input as the color change symbol "pencil" δ, input is reduced and work efficiency is improved.

Figure 9:
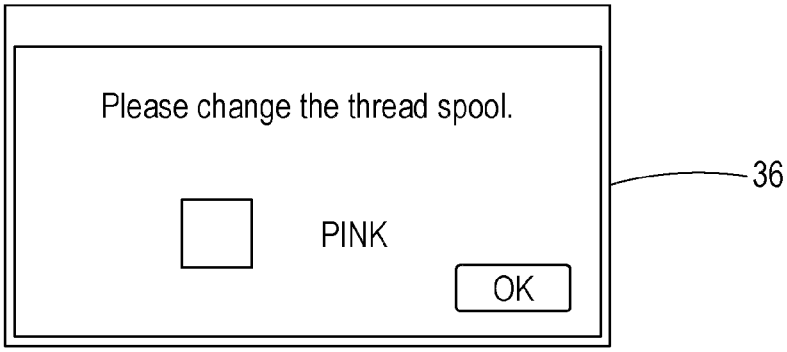
FIG. 9 is a diagram illustrating a display state of a thread pool change display window.

Furthermore, when the thread color is to be changed, as illustrated in FIG. 9, the thread color (pink in the example) may be popped up and displayed with a thread spool change display window 36 in the pattern string mode screen 24 to prompt change of the thread spools and to enable the user to confirm the color of the thread to be changed.

In the case of the present exemplary embodiment in which the pattern string that is input as "Address 'single finger' 'double circle' 'scissors' Tokyo 'single finger' 'double circle' 'scissors' 'pencil' Hachioji" is sewed in the above manner, preparation is performed beforehand such that the needle is threaded with green thread.

When the S/S switch 12 or the foot controller 13 is operated to start the sewing machine, the sewing machine motor 7 that drives the sewing mechanism 19 is started and a timing signal TS is output from the arm shaft phase sensor 23 that is interlocked with the sewing machine 19.

The timing signal TS is output each time a single stitch is formed with a needle thread and a bobbin thread upon a single rotation of the arm shaft, and the output timing signal TS is input to the CPU 14.

Each time a timing signal TS is input, the CPU 14 reads out, from the second storage device 16, stitch data amounting to a single stitch of the pattern data that is to be stitched subsequently, outputs the "swing" data and the "feed" data of the stitch data, which have been read out, to the swing/feed motor controller 20 and controls the swing/feed motor 21 so as to actuate the needle-bar left-right swinging mechanism and the feed-dog forward-rearward feeding mechanism that constitute the sewing mechanism 19 to sew the combinational pattern.

Figure 10:
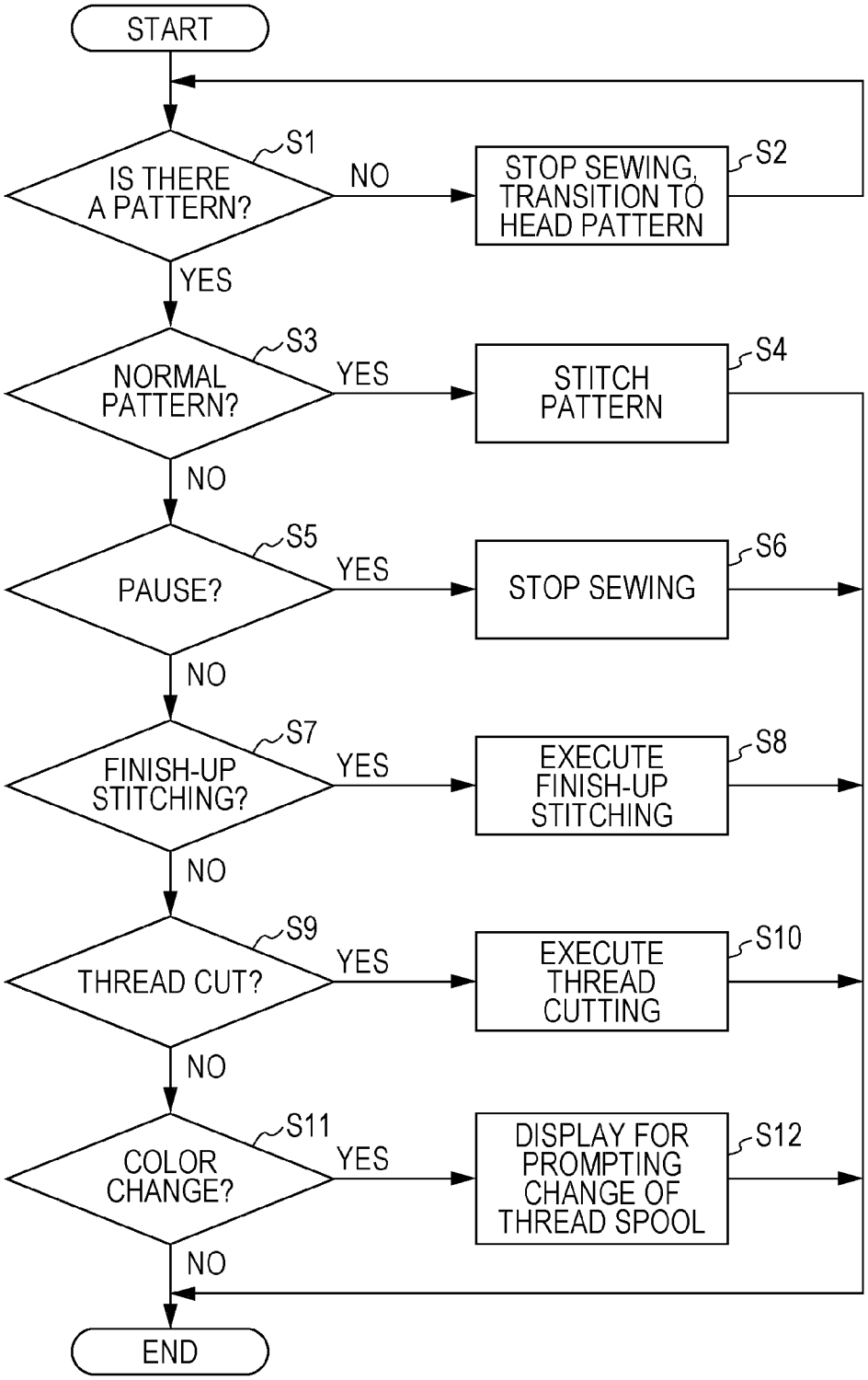
FIG. 10 is a flowchart illustrating a mode of transition from a pattern to the next pattern of a pattern string.

Herein, a mode of transition from a single pattern to the next single pattern when sewing a pattern string that is displayed in the pattern string display window 25 in FIG. 7 will be described with reference to the flowchart in FIG. 10.

When the sewing machine is started, in step S1, a determination is made on whether there is any subsequent pattern on the basis of the attribute data (the pattern type) of the pattern data that has been read out from the second storage device 16. Since the attribute data is not "0" that denotes the "terminal of the pattern data string", it is determined that there is a subsequent pattern and the process proceeds to step S3.

Subsequently, in step S3, a determination is made on whether the pattern type is a normal pattern. As illustrated in FIG. 6, since the pattern at the start of sewing is an alphabetic character "A" and the attribute data of the pattern data is "1" that denotes the "normal pattern", it is determined that the pattern type is a normal pattern and the process proceeds to step S4.

In step S4, on the basis of the "swing" data and the "feed" data that constitute the stitch data of the pattern "A", the pattern, the "stitch number" of which is n1, is sewed to the end while synchronizing with the timing signal TS from the arm shaft phase sensor 23, and the subsequent stitch data is read out from the second storage device 16.

Since the patterns from the second pattern "d" to the seventh pattern "s" are normal patterns, similar to pattern "A" described above, the process that goes through step S1 and step S3 and that sews the pattern to the end in step S4 is repeated six times.

After sewing the seventh pattern "s" in which the "stitch number" is n2, the eighth pattern data is read out from the second storage device 16 and, after going through step S1 and step S3, the process proceeds to step S5. In step S5, a determination is made on whether the pattern type is a pause. Since the attribute data of the eighth pattern data is "2" that denotes a "pause", it is determined that the pattern type is a pause and the process proceeds to step S6.

In step S6, control data serving as a pause signal is sent to the sewing machine motor controller 18 from the CPU 14 to stop the sewing machine when the needle 9, in accordance with the timing signal TS from the arm shaft phase sensor 23, reaches a portion near the bottom dead center.

After the sewing machine is stopped, the ninth pattern data is read out from the second storage device 16 and, after going through step S1, step S3, and step S5, the process proceeds to step S7. In step S7, a determination is made on whether the pattern type is finish-up stitching. Since the attribute data of the ninth pattern data is "3" that denotes "finish-up stitching", it is determined that the pattern type is finish-up stitching data and the process proceeds to step S8.

In step S8, control data is sent to the sewing machine motor controller 18 from the CPU 14 to stop the sewing machine when the needle 9 reaches a portion near the top dead center after the finish-up stitching of a few stitches are performed in accordance with the timing signal TS from the arm shaft phase sensor 23.

When the sewing machine is stopped, the 10th pattern data is read out from the second storage device 16 and, after going through step S1, step S3, step S5, and step S7, the process proceeds to step S9. In step S9, a determination is made on whether the pattern type is thread cutting. Since the attribute data of the 10th pattern data is "4" that denotes "thread cutting", it is determined that the pattern type is thread cutting data and the process proceeds to step S10.

In step S10, control data are sent to the sewing machine motor controller 18 from the CPU 14 in order to perform thread cutting by actuating a thread cutting knife (not shown) at a point when the timing signal TS from the arm shaft phase sensor 23 indicates that the needle 9 has started to ascend from the bottom dead center, and in order to stop the sewing machine when the needle 9 reaches a portion near the top dead center.

After the sewing machine has been stopped and the sewing position has been changed, when the sewing machine is started once more, the subsequent pattern data is read out from the second storage device 16. Since the patterns from the 11th pattern "T" to the 15th pattern "o" are normal patterns, similar to pattern "A" described above, the process that goes through step S1 and step S3 and that sews the pattern to the end in step S4 is repeated five times.

After sewing of the 15th pattern "o" is completed, the 16th pattern data is read out from the second storage device 16. Since the 16th pattern data is the same as the eighth pause data, after going through step S1, step S3, and step S5, the process proceeds to step S6 so as to pause the sewing machine.

When the sewing machine is stopped, the 17th pattern data is read out from the second storage device 16. Since the 17th pattern data is the same as the ninth finish-up stitching data, after going through step S1, step S3, step S5, and step S7 and after proceeding to step S8 and performing finish-up stitching of a few stitches, the sewing machine is stopped.

When the sewing machine is stopped, the 18th pattern data is read out from the second storage device 16. Since the 18th pattern data is the same as the 10th thread cutting data, after going through step S1, step S3, step S5, step S7, and step S9 and after proceeding to step S10 and performing thread cutting, the sewing machine is stopped.

After the sewing machine is stopped, the 19th pattern data is read out from the second storage device 16, and the process goes through step S1, step S3, step S5, step S7, and step S9 and proceeds to step S11. In step S11, a determination is made on whether the pattern type is color change. Since the attribute data of the 19th pattern data is "5" that denotes "color change", it is determined that the pattern type is color change data and the process proceeds to step S12.

In step S12, in order to notify the user that the timing to change the thread spool has come, as illustrated in FIG. 9, the thread color (pink in the example) is popped up and displayed with a thread spool change display window 36 in the pattern string mode screen 24 to prompt change of the thread spools.

After changing the thread spool from green to pink, when the sewing machine is started once more, the subsequent pattern data is read out from the second storage device 16. Since the patterns from the 20th pattern "H" to the 27th pattern "i" are normal patterns, similar to pattern "A" described above, the process that goes through step S1 and step S3 and that sews the pattern to the end in step S4 is repeated eight times.

After the 27th pattern "i" is sewed in which the "stitch number" is n4, the 28th pattern data is read out from the second storage device 16. In step S1, a determination is made on whether there is any subsequent pattern on the basis of the attribute data of the pattern data. Since the attribute data of the pattern data is "0" that denotes the "terminal of the pattern data string", it is determined that there is no subsequent pattern and, since sewing has been performed to the last pattern that constitutes the pattern string, the process proceeds to step S2. In step S2, similar to step S6, the sewing machine is stopped. Since the first pattern "A" needs to be sewed again at the next start, transition is made to the first pattern "A" and the sewing machine enters a standby state.

As described above, by inserting and adding symbols other than the normal pattern, such as the "single finger" that is a pause symbol, at an optional position midway of the pattern string displayed on the screen display device, the sewing machine can be automatically paused, for example, in the midst of sewing the pattern string to enable the sewing position to be changed and the timing to change colors of the needle thread to be notified to the user.

As illustrated in FIG. 4, in the above example, an exemplary case in which alphabetical characters are sewed as a combinational pattern has been described. Subsequently, as illustrated in FIG. 11B, a case will be described as an example of sewing a combinational pattern including stitched ornament patterns, in which sewing is paused after two tulip patterns are sewed as the stitched ornament patterns, in which the sewing direction is turned 90 degrees, and in which two tulip patterns are further sewed.

Figure 11A:
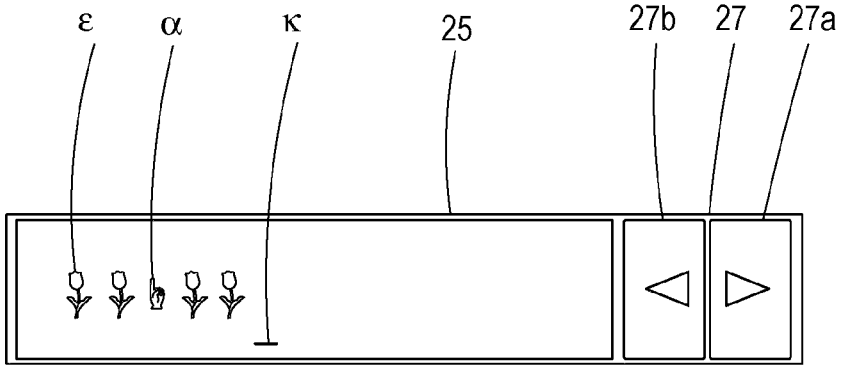
Figure 11B:
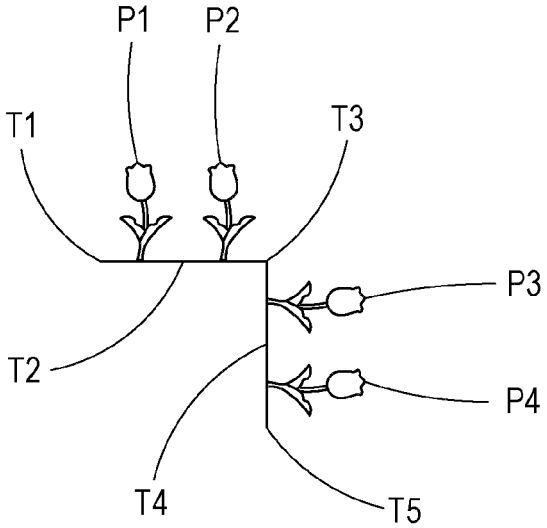

As illustrated in FIG. 11A, four tulip patterns ϵ that are stitched ornament patterns are displayed in the pattern string display window 25 and the "single finger" α that is a pause symbol is displayed between the tulip patterns ϵ.

Accordingly, similar to the examples in FIGS. 5 and 7 described above, in the pattern strings display mode, a selection key (not shown) of the stitched ornament pattern serving as a normal pattern is operated to input four tulip patterns ϵ.

Subsequently, the leftward shift key 27*b* of the cursor shift key 27 is operated to shift the cursor κ displayed in the pattern string display window 25 to a portion directly under the third tulip pattern ϵ.

Then, the pause symbol key (not shown) is operated to insert and add the "single finger" α that is a pause symbol between the second and third tulip patterns ϵ.

At the same time as above, the pattern data (the command data) of the pause data that has been selected from the first storage device 15 illustrated in FIG. 2 through the key operation is read out to the CPU 14 and is interrupted between the second and third "tulip" patterns of the pattern data string stored in the second storage device 16 such that the pause data is written therein.

When the S/S switch 12 or the foot controller 13 is operated and the sewing machine is started, as illustrated in FIG. 11B, in a similar manner to the above-described case in which the pattern string formed of alphabetical characters is sewed, after sewing of a first tulip pattern P1 that starts from a needle location point T1 and that is finished at the needle location point T2 is completed, when the sewing of a second tulip pattern P2 is started from the needle location point T2 and is completed and when the needle 9 reaches a portion near the bottom dead center of a needle location point T3, the sewing machine pauses automatically.

Subsequently, a presser foot of the sewing machine is lifted up, fabric through which the needle 9 penetrates is turned 90 degrees in the left direction, and the presser foot is lowered once more.

When the S/S switch 12 or the foot controller 13 is operated once more and the sewing machine is started, after sewing of a third tulip pattern P3 that starts from a needle location point T3 and that is finished at a needle location point T4 is completed, when the sewing of a fourth tulip pattern P4 is started from the needle location point T4 and is completed and when determination is made that it is the terminal of the pattern string, the sewing machine pauses automatically at a needle location point T5.

Second Exemplary Embodiment

A second exemplary embodiment in which a zigzag sewing machine is paused by operating the zigzag sewing machine through a terminal, such as a personal computer or a tablet, that is capable of communicating with the sewing machine will be described next.

In the present embodiment, components that are the same as the first embodiment will be designated with the same reference numerals and will be illustrated in the drawings so as to omit detailed description thereof, and points that are different will be described mainly.

Figure 12:
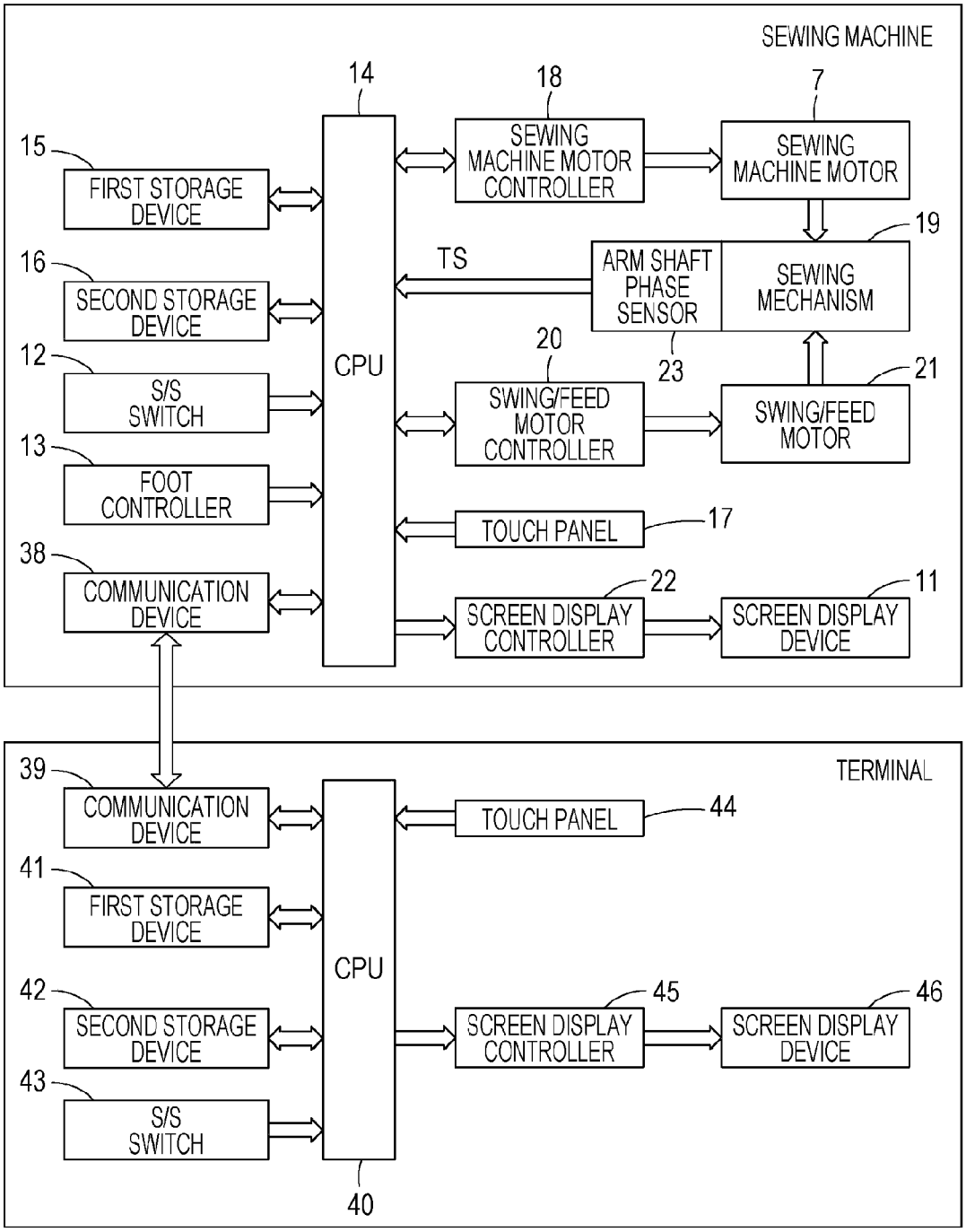
FIG. 12 is a block diagram illustrating a control system of a zigzag sewing machine and a terminal of a second exemplary embodiment.

As illustrated in the block diagram in FIG. 12, in the zigzag sewing machine and the terminal of the present exemplary embodiment, a communication device 38 of the sewing machine and a communication device 39 of the terminal are connected to each other via a LAN cable or wireless LAN.

The sewing machine is the same as the sewing machine of the first exemplary embodiment except that the sewing machine is provided with the communication device 38.

As can be seen in the block diagram in FIG. 12, the terminal has a block configuration similar to that of the zigzag sewing machine except that the terminal is not provided with devices related to the sewing mechanism and the foot controller.

A CPU 40 of the terminal is coupled to a first storage device 41 composed of a ROM with an I/O bus and is coupled to a second storage device 42 composed of a RAM with an I/O bus.

An S/S switch 43 is coupled to the CPU 40 with an I/O bus and, similar to the S/S switch 12 of the sewing machine, operation of the S/S switch 43 starts the sewing machine that is at a stop and stops the sewing machine that is in operation.

Furthermore, a screen display device 46 is coupled to a screen display controller 45. Similar to the screen display device 11 of the sewing machine, the screen display device 46 is constituted by a liquid crystal display portion and a transparent touch panel 44 stacked on the front side of the liquid crystal display portion. The CPU 40 receives an operation signal from the touch panel 44 and controls the screen display controller 45, and by switching the screen, various displays related to pattern stitching are displayed on the liquid crystal display portion and, further, various screen keys that are constituted together with the transparent touch panel 44 are displayed.

In the present exemplary embodiment, in order to sew the pattern string illustrated in FIG. 4, a pause symbol may be added, at a portion after the pattern where pausing is intended, by operating the terminal in the same manner as when the normal pattern is added. Regarding the addition of the pause symbol with the terminal, the pause symbol can be input while the patterns are input in order from the top, or the pause symbol may be added by, after the pattern string has been input, inserting the pause symbol at any position in the pattern string.

The operation on the terminal is performed using a screen display device 46, a front side of which is stacked with the transparent touch panel 44, and same as the screen display device 11 of the first exemplary embodiment, the operation on the terminal can be performed in a manner similar to the key operation on the pattern string mode screen 24 illustrated in FIGS. 5 and 7.

With the key operation, a pattern sting illustrated in FIG. 7 that includes, other than the alphabetical character patterns, the "single finger" α that is a pause symbol, the "double circle" β that is a finish-up stitching symbol, the "scissors" γ that is a thread cutting symbol, and the "pencil" δ that is a color change symbol is ultimately displayed in the pattern string display window 25 of the pattern string mode screen 24 of the screen display device 46 of the terminal.

Note that similar to the first exemplary embodiment, in the present exemplary embodiment as well, as illustrated in FIG. 7, symbols are inserted in the screen display device 46 of the terminal in a continuous manner such as the "single finger" α that is a pause symbol, the "double circle" β that is a finish-up stitching symbol, and the "scissors" γ that is a thread cutting symbol, and such as the "single finger" α, the "double circle" β, the "scissors" γ, and the "pencil" δ that is a color change symbol.

Now, since the symbols need to be input nearly as a set, as illustrated in FIG. 8, by allowing the finish-up stitching symbol and the thread cutting symbol to be collectively abbreviated to and input as the thread cutting symbol "scissors" γ, and similarly, by allowing the finish-up stitching symbol, the thread cutting symbol, and the color change symbol to be collectively abbreviated to and input as the color change symbol "pencil" δ, input can be reduced.

A control method of pausing the zigzag sewing machine with the terminal will be described next.

As a method of automatically pausing the sewing machine while the sewing machine is sewing the pattern in order, there is a method in which a command to pause sewing is sent to the sewing machine from the terminal.

Herein, the above will be described with an example in which pausing is performed before "Tokyo" when sewing "AddressTokyo".

Note that it is assumed that "Address 'single finger' Tokyo" has already been input to the terminal.

In the above method, the terminal sends a pattern string that has excluded pause data to the sewing machine in advance and, then, the terminal transmits a pause command to the sewing machine that is in the midst of sewing the pattern string.

Figure 13:
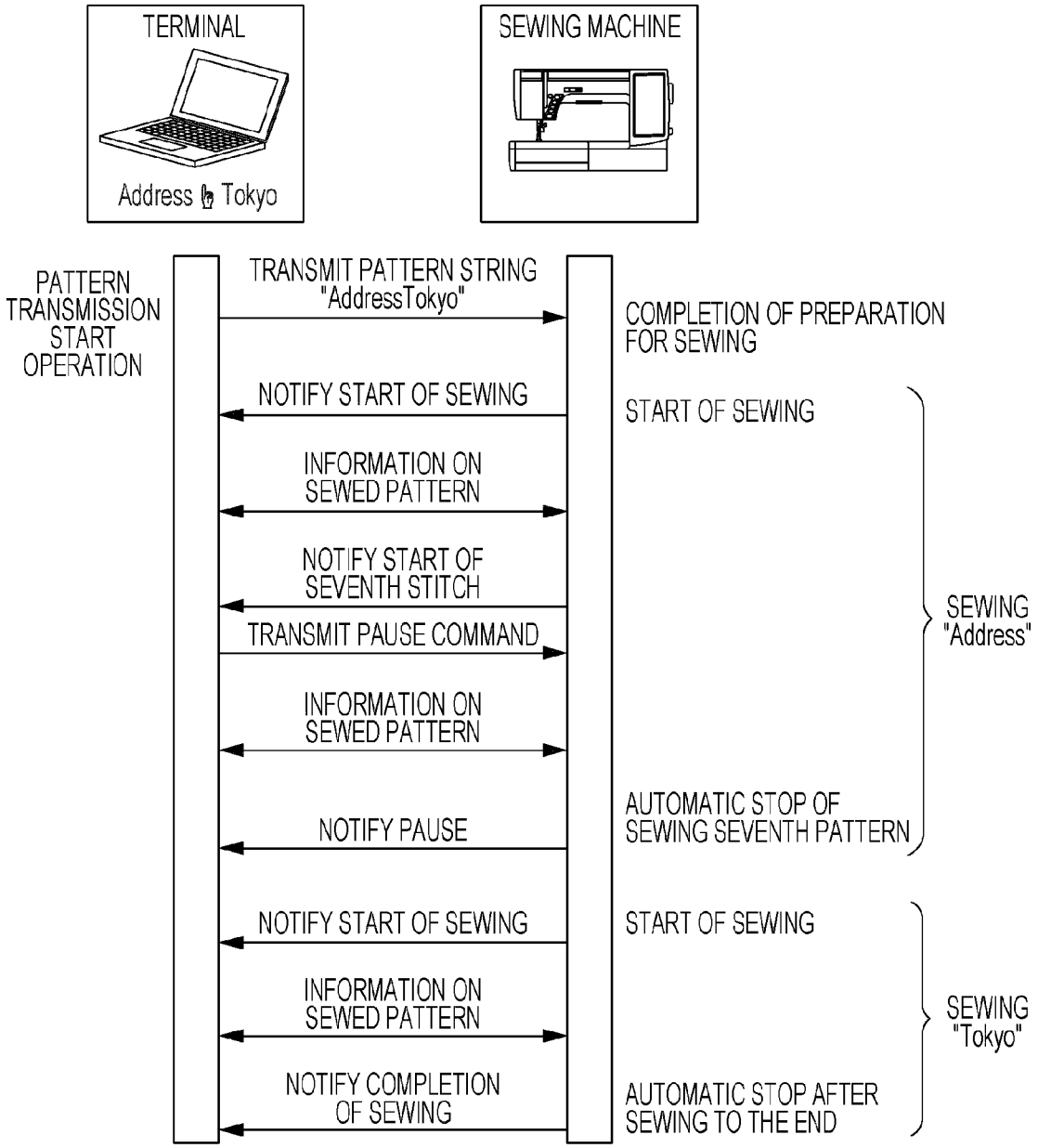
FIG. 13 is the sequence diagram illustrating a communication state between the terminal and the sewing machine.

At this time, the communication state of the terminal and the sewing machine described with a sequence diagram in FIG. 13 is as follows.

When the user performs "pattern transmission start operation" on the terminal, the pattern string "AdressTokyo" is transmitted to the sewing machine.

When the sewing machine starts sewing the received pattern string "AddressTokyo", the sewing machine transmits a "start of sewing" to the terminal before starting sewing.

While the sewing machine is sewing the received pattern string "AdressTokyo", communication is regularly performed between the terminal and the sewing machine to exchange the sewing state and the like.

Then, when sewing of the seventh pattern "s" is started, the sewing machine transmits the notification "start of sewing" to the terminal.

Thereupon, the terminal that has received the "start of sewing" transmits a pause command to the sewing machine.

The sewing machine that has received the pause command pauses after sewing of the pattern "s" in the pattern string is completed and, at the same time, transmits a notification "completion of sewing" to the terminal.

When the sewing machine is started again to sew the continuing portion of the pattern string "Tokyo", the sewing machine transmits a "start of sewing" to the terminal before starting sewing.

While the sewing machine is sewing the pattern string "Tokyo", the terminal and the sewing machine regularly communicate with each other to exchange the sewing state and the like.

When sewing of the last pattern "o" is completed, the sewing machine automatically stops and, at the same time, transmits a notification "completion of sewing" to the terminal.

Figure 14:
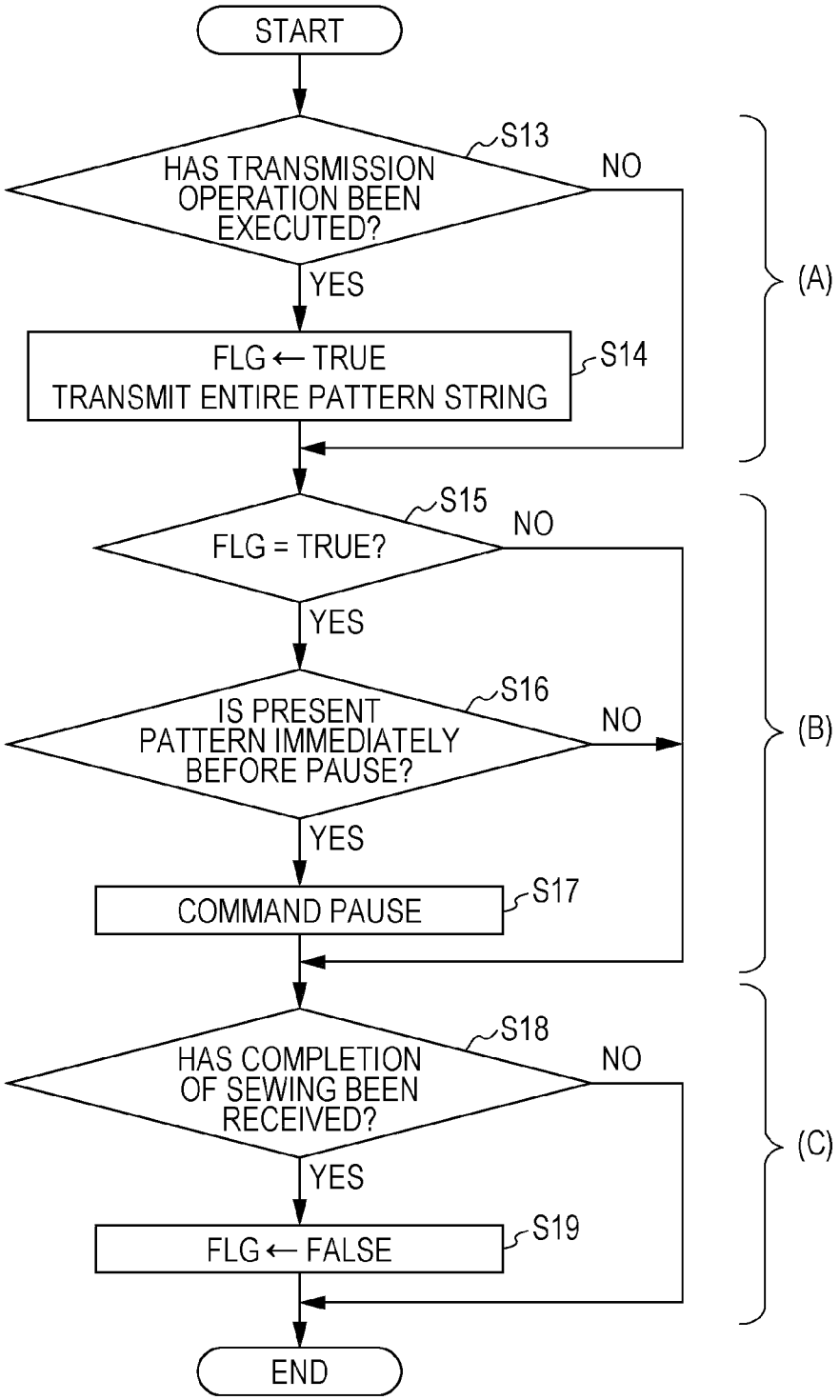
FIG. 14 is a flowchart illustrating a mode of a pause command issued by the terminal.

A mode of the pause command issued by the terminal will be described briefly with the flowchart in FIG. 14.

Variables used in the flowchart are as follows. These variables are declared globally and are to maintain their values after activation of the function.

"flg": when the "pattern transmission start operation" is performed on the terminal, the flg is set to True and when the sewing is completed to the end, the flg is set to False. When powered up, the flg is assumed to be initialized to False.

(A) When the user performs the pattern transmission start operation on the terminal, determination is made on whether transmission operation has been executed in step S13. Since the transmission operation has been executed, it is determined that the transmission operation has been executed and the process proceeds to step S14.

Subsequently, a flg is set (False is turned to True) in step S14 and the whole pattern string "AdressTokyo" is transmitted to the sewing machine.

(B) In step S15, determination is made on whether the flg is set to True. Since the flg is kept to be True until the sewing is completed, it is determined that the flg is set to True and the process proceeds to step S16.

Subsequently, in step S16, determination is made on whether the current pattern is immediately before the pause. Since current pattern is not immediately before the pause when the sewing machine is sewing the patterns between the first pattern "A" and the sixth pattern "s", it is determined to be No, and the process proceeds to step S18, and in step S18, it is determined that completion of sewing has not been received and the process is ended.

Then, when sewing of the seventh pattern "s" is started, in step S16, it is determined that the current pattern is a pattern immediately before the pause and the process proceeds to step S17.

Subsequently, in step S17, a pause command is transmitted to the sewing machine.

(C) When the sewing machine completes sewing the seventh pattern "s", notification of the completion of sewing is transmitted to the terminal, and in step S18, determination is made on whether completion of sewing has been received. Since the completion of sewing is received, it is determined to be Yes and the process proceeds to step S19.

Subsequently, in step S19, the flg is cleared (True is turned to False) and is returned to the initialized state, and the process is ended.

As described above, in the present exemplary embodiment, no positional information on the pause is included in the pattern data of the pattern string that is input to the zigzag sewing machine and the pausing position is set on the terminal side, such as a personal computer or a tablet, that communicates with the sewing machine, and a pause command is transmitted to the sewing machine from the tablet when the sewing machine that is in the midst of sewing reaches a pausing position; accordingly, the sewing machine can be stopped.

Other operational advantages are similar to those of the first exemplary embodiment.

When sewing a pattern string with combination stitching, the zigzag sewing machine of the present disclosure automatically pauses the sewing machine at a position where the pause data has been inserted in the pattern data string; accordingly, not like when the user manually stops the sewing machine, the user does not have to look for the timing to stop the sewing machine and, thus, labor of the user can be reduced and the zigzag sewing machine of the present disclosure can be advantageously applied to a wide range of various zigzag sewing machines.

What is claimed is:

1. A zigzag sewing machine that sews a combinational pattern, the zigzag sewing machine comprising:

a sewing mechanism that is driven by a sewing machine drive unit, the sewing mechanism forming a stitch pattern by a left-right swing of a vertically reciprocating needle bar mounted with a needle at a lower end thereof and by a forward-rearward feed of a feed dog;

a first storage device that stores a plurality of pieces of pattern data including attribute data related to a pattern type and stitch data that controls the left-right swing of the needle bar and the forward-rearward feed of the feed dog;

a pattern selection section that sequentially selects optional pattern data from the plurality of pieces of pattern data stored in the first storage device;

a second storage device that stores a plurality of pieces of pattern data that have been selected by the pattern selection section as an arranged combinational pattern;

a command data insertion section that inserts and adds pause data at an optional position midway of a pattern data string constituting the combinational pattern stored in the second storage device;

a pause command section that reads out a pause data that has been inserted and added with the command data insertion section and that supplies the pause signal to the sewing machine drive unit; and a display device that displays the combinational pattern corresponding to the pattern data selected with the pattern selection section, the display device further displaying a pause symbol, the pause symbol corresponding to the pause data that has been inserted and added with the command data insertion section, at a position in the combinational pattern where the pause symbol has been inserted and added.

2. The zigzag sewing machine according to claim 1, wherein the command data insertion section includes the pattern selection section that selects pause data from the plurality of pieces of pattern data stored in the first storage device, and the second storage device that inserts the pause data that has been selected with the pattern selection section at an optional position midway of the pattern data string constituting the combinational pattern and that stores the pause data.

3. The zigzag sewing machine according to claim 2, wherein the pause command section includes a pattern data readout section that reads out the pattern data of the combinational pattern that is stored in the second storage device, an attribute data determination section that determines whether attribute data of the pattern data that has been read out with the pattern data readout section is pause data, and a pause signal supply section that supplies the pause signal to the sewing machine drive unit on a basis of a determination result of the attribute data determination section.

4. The zigzag sewing machine according to claim 3, wherein the attribute data determination section includes a normal pattern data determination section that determines whether the attribute data of the pattern data that has been read out with the pattern data readout section is normal pattern data, and a pause data determination section that, when the attribute data of the pattern data is determined not to be normal pattern data with the normal pattern data determination section, determines whether the attribute data of the pattern data is pause data.

5. The zigzag sewing machine according to claim 4, wherein the command data insertion member further inserts and adds finish-up stitching data and thread cutting data, and the attribute data determination section further includes a finish-up stitching data determination section that, when the attribute data of the pattern data is determined not to be pause data with the pause data determination section, determines whether the attribute data of the pattern data is finish-up stitching data, and a thread cutting data determination section that, when the attribute data of the pattern data is determined not to be finish-up stitching data with the finish-up stitching data determination section, determines whether the attribute data of the pattern data is thread cutting data.

6. The zigzag sewing machine according to claim 5, wherein the command data insertion section further inserts and adds color change data, and the attribute data determination section further includes a color change data determination section that, when the attribute data of the pattern data is determined not to be thread cutting data with the thread cutting data determination section, determines whether the attribute data of the pattern data is color change data.

7. The zigzag sewing machine according to claim 1, wherein the pause command section includes a pattern data readout section that reads out the pattern data of the combinational pattern that is stored in the second storage device, an attribute data determination section that determines whether attribute data of the pattern data that has been read out with the pattern data readout section is pause data, and a pause signal supply section that supplies the pause signal to the sewing machine drive unit on a basis of a determination result of the attribute data determination section.

8. The zigzag sewing machine according to claim 7, wherein the attribute data determination section includes a normal pattern data determination section that determines whether the attribute data of the pattern data that has been read out with the pattern data readout section is normal pattern data, and a pause data determination section that, when the attribute data of the pattern data is determined not to be normal pattern data with the normal pattern data determination section, determines whether the attribute data of the pattern data is pause data.

9. The zigzag sewing machine according to claim 8, wherein the command data insertion section further inserts and adds finish-up stitching data and thread cutting data, and the attribute data determination section further includes a finish-up stitching data determination section that, when the attribute data of the pattern data is determined not to be pause data with the pause data determination section, determines whether the attribute data of the pattern data is finish-up stitching data, and a thread cutting data determination section that, when the attribute data of the pattern data is determined not to be finish-up stitching data with the finish-up stitching data determination section, determines whether the attribute data of the pattern data is thread cutting data.

10. The zigzag sewing machine according to claim 9, wherein the command data insertion section further inserts and adds color change data, and the attribute data determination section further includes a color change data determination section that, when the attribute data of the pattern data is determined not to be thread cutting data with the thread cutting data determination section, determines whether the attribute data of the pattern data is color change data.

11. An automatic-pause control method of a zigzag sewing machine, the zigzag sewing machine being driven by a sewing machine drive unit and forming a stitch pattern by a left-right swing of a vertically reciprocating needle bar mounted with a needle at a lower end thereof and by a forward-rearward feed of a feed dog, the method comprising the steps of:

sequentially selecting optional pattern data from a first storage device that stores a plurality of pieces of pattern data including attribute data related to a pattern type and stitch data that controls the left-right swing of the needle bar and the forward-rearward feed of the feed dog;

storing, in a second storage device, the plurality of pieces of pattern data that have been selected in the step of sequentially selecting pattern data as an arranged combinational pattern;

displaying, on a display device, the combinational pattern corresponding to the pattern data selected in the step of sequentially selecting pattern data;

inserting and adding pause data at an optional position midway of a pattern data string constituting the combinational pattern stored in the step of storing in the second storage device;

displaying a pause symbol that corresponds to the pause data inserted in the step of inserting and adding pause data, the pause symbol being displayed in the combinational pattern on the display device at a positon where the pause symbol has been inserted; and supplying a pause signal to the sewing machine drive unit after reading out the pause data that have been inserted in the step of inserting and adding pause data.

12. The automatic-pause control method of a zigzag sewing machine according to claim 11, wherein the step of inserting and adding pause data includes the steps of selecting pause data from the first storage device, and inserting and adding the pause data that has been selected in the step of selecting pause data at an optional position midway of the pattern data string constituting the combinational pattern stored in the second storage device.

13. The automatic-pause control method of a zigzag sewing machine according to claim 12, wherein the step of supplying a pause signal to the sewing machine drive unit includes the steps of reading out pattern data related to the combinational pattern that has been stored in the step of storing in the second storage device, determining whether attribute data of the pattern data read out in the step of reading out pattern data is pause data, and supplying a pause signal to the sewing machine drive unit on a basis of a determination result of the step of determining whether the attribute data is pause data.

14. The automatic-pause control method of a zigzag sewing machine according to claim 13, wherein the step of determining whether the attribute data is pause data includes the steps of determining whether the attribute data of the pattern data read out in the step of reading out pattern data is normal pattern data, and determining whether the attribute data of the pattern data is pause data when the attribute data of the pattern data is determined not to be normal pattern data in the step of determining whether the attribute data is normal pattern data.

15. The automatic-pause control method of a zigzag sewing machine according to claim 14, wherein the step of inserting and adding pause data further includes inserting and adding finish-up stitching data and thread cutting data, and the step of determining whether the attribute data is pause data further includes the steps of determining whether the attribute data of the pattern data is finish-up stitching data when the attribute data is determined not to be normal pattern data and when the attribute data of the pattern data is determined not to be pause data in the step of determining whether the attribute data of the pattern data is pause data, and determining whether the attribute data of the pattern data is thread cutting data when the attribute data of the pattern data is determined not to be finish-up stitching data in the step of determining whether the attribute data is finish-up stitching data.

16. The automatic-pause control method of a zigzag sewing machine according to claim 15, wherein the step of inserting and adding pause data further includes inserting and adding color change data, and the step of determining whether the attribute data is pause data further includes the step of determining whether the attribute data of the pattern data is color change data when the attribute data of the pattern data is determined not to be thread cutting data in the step of determining whether the attribute data is thread cutting data.

17. The automatic-pause control method of a zigzag sewing machine according to claim 11, wherein the step of supplying a pause signal to the sewing machine drive unit includes the steps of reading out pattern data related to the combinational pattern that has been stored in the step of storing in the second storage device, determining whether attribute data of the pattern data read out in the step of reading out pattern data is pause data, and supplying a pause signal to the sewing machine drive unit on a basis of a determination result of the step of determining whether the attribute data is pause data.

18. The automatic-pause control method of a zigzag sewing machine according to claim 17, wherein the step of determining whether the attribute data is pause data includes the steps of determining whether the attribute data of the pattern data read out in the step of reading out pattern data is normal pattern data, and determining whether the attribute data of the pattern data is pause data when the attribute data of the pattern data is determined not to be normal pattern data in the step of determining whether the attribute data is normal pattern data.

19. The automatic-pause control method of a zigzag sewing machine according to claim 18, wherein the step of inserting and adding pause data further includes inserting and adding finish-up stitching data and thread cutting data, and the step of determining whether the attribute data is pause data further includes the steps of determining whether the attribute data of the pattern data is finish-up stitching data when the attribute data is determined not to be normal pattern data and when the attribute data of the pattern data is determined not to be pause data in the step of determining whether the attribute data of the pattern data is pause data, and determining whether the attribute data of the pattern data is thread cutting data when the attribute data of the pattern data is determined not to be finish-up stitching in the step of determining whether the attribute data is finish-up stitching data.

20. The automatic-pause control method of a zigzag sewing machine according to claim 19, wherein the step of inserting and adding pause data further includes inserting and adding color change data, and the step of determining whether the attribute data is pause data further includes the step of determining whether the attribute data of the pattern data is color change data when the attribute data of the pattern data is determined not to be thread cutting data in the step of determining whether the attribute data is thread cutting data.

* * * * *